US005516420A

United States Patent [19]

Henton

[11] Patent Number: 5,516,420

[45] Date of Patent: May 14, 1996

[54] MAGNETICALLY SEPARATED EQUILIBRIUM CATALYST FOR SPECIALIZED CRACKING

[75] Inventor: Lee M. Henton, Lavalette, W. Va.

[73] Assignee: Ashland Inc., Ashland, Ky.

[21] Appl. No.: 240,402

[22] Filed: May 10, 1994

[51] Int. Cl.[6] ..... C10G 51/02; C10G 11/00

[52] U.S. Cl. ..... 208/74; 208/113; 208/155; 208/162; 208/164

[58] Field of Search ..... 208/74, 113, 155, 208/163, 164

[56] References Cited

U.S. PATENT DOCUMENTS

| | | | |
|---|---|---|---|
| 4,359,379 | 11/1982 | Ushio | 208/120 |
| 4,406,773 | 9/1983 | Hettinger | 208/120 |
| 4,591,425 | 5/1986 | Kovach | 208/74 |
| 4,606,810 | 8/1986 | Krambeck et al. | 208/164 |

OTHER PUBLICATIONS

"Shreve's Chemical Process Industries", 5th ed. by George T. Austin, Chapter 37, pp. 735–740 (no date).

"Petroleum Refining Technology & Economics", 2nd ed., by James H. Gary & Glenn E. Handwerk, Chapter 7, pp. 99–108 (no date).

*Primary Examiner*—E. Rollins Cross
*Assistant Examiner*—Walter D. Griffin
*Attorney, Agent, or Firm*—Richard C. Willson, Jr.

[57] ABSTRACT

Disclosed is a method for improving fluid cracking catalyst performance by increasing metal contamination incrementally while cracking two different feedstocks that have different concentrations of metal contaminants. The relative amount of metal contamination is controlled by magnetic separation. The incrementally increased cracking catalyst is used in cracking a second feedstock.

7 Claims, 1 Drawing Sheet

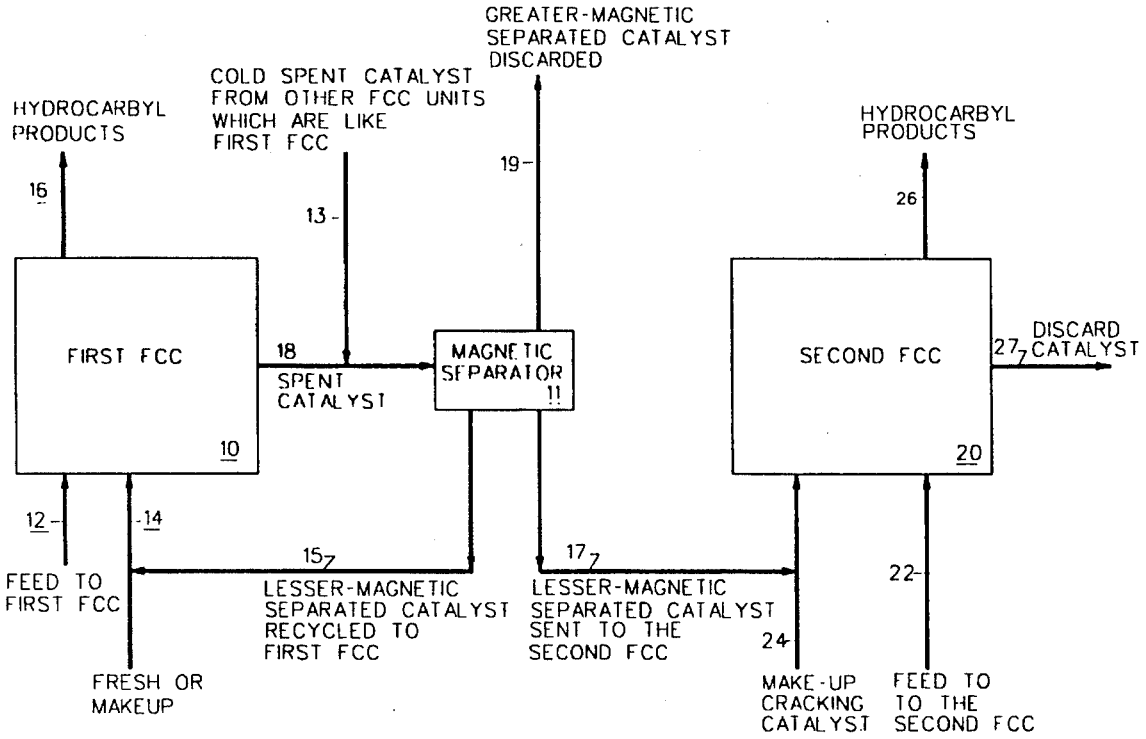

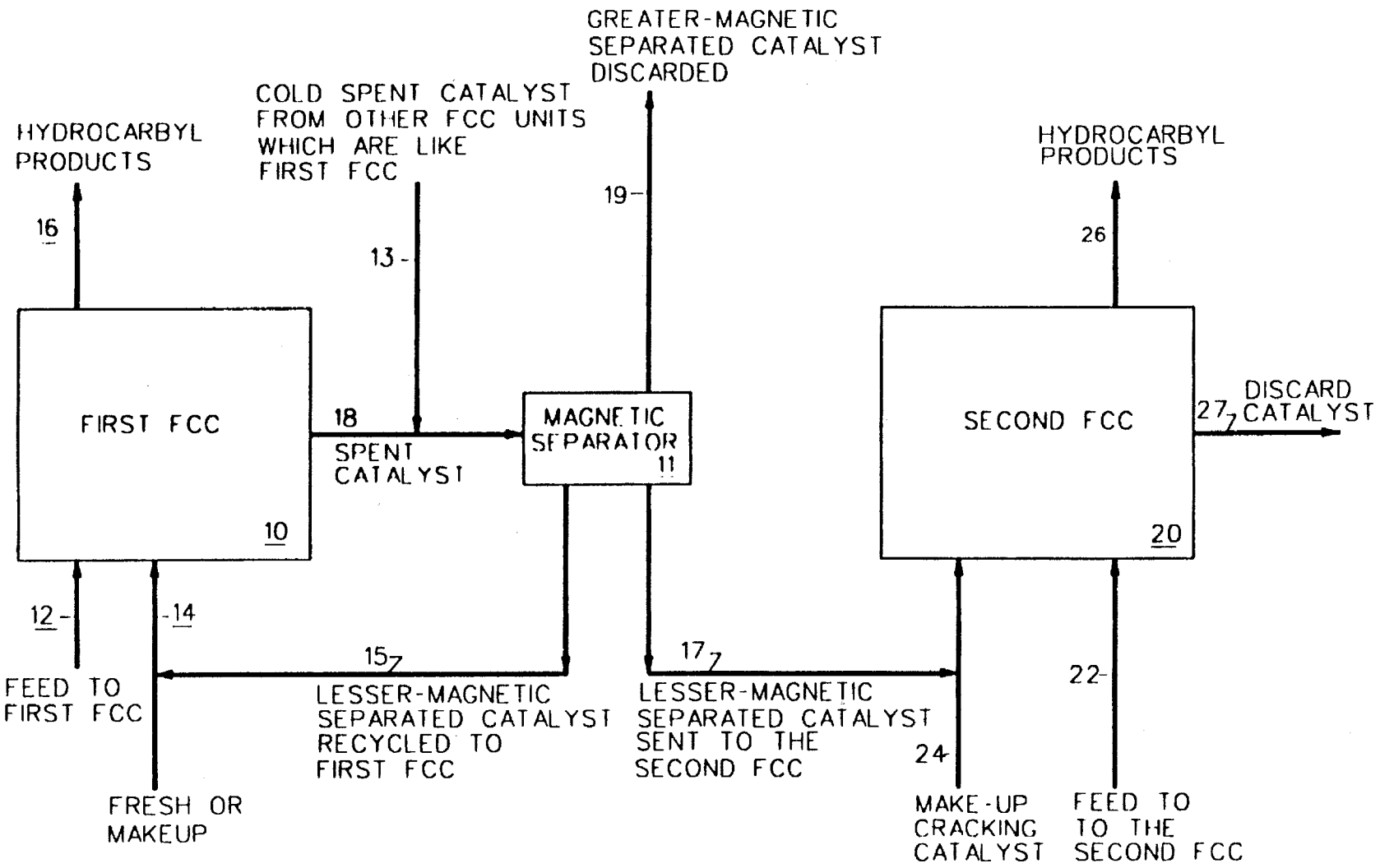
HYDROCARBYL PRODUCTS
16
FIRST FCC
10
COLD SPENT CATALYST FROM OTHER FCC UNITS WHICH ARE LIKE FIRST FCC
13
FEED TO FIRST FCC
12
GREATER-MAGNETIC SEPARATED CATALYST DISCARDED
19
MAGNETIC SEPARATOR 11
18
SPENT CATALYST
14
FRESH OR MAKEUP
15
LESSER-MAGNETIC SEPARATED CATALYST RECYCLED TO FIRST FCC
17
LESSER-MAGNETIC SEPARATED CATALYST SENT TO THE SECOND FCC
HYDROCARBYL PRODUCTS
26
SECOND FCC
20
DISCARD CATALYST
27
FEED TO TO THE SECOND FCC
22
MAKE-UP CRACKING CATALYST
24

MAGNETICALLY SEPARATED EQUILIBRIUM CATALYST FOR SPECIALIZED CRACKING

CROSS REFERENCE TO RELATED APPLICATIONS

U.S. Pat. No. 4,591,425 relates to the field of transferring of catalyst from a fluid catalytic cracking unit to a reduced crude catalytic cracking unit to a metals removal unit. U.S. Pat. No. 4,406,773 relates to separation of metal contaminated cracking catalysts from a fluid catalytic cracking unit to improve activity upon recycling back to the fluid catalytic cracking unit.

BACKGROUND OF INVENTION

I. Field of the Invention

This invention relates to hydrocarbon conversions involving catalytic cracking. It also relates to magnetic separation of metal contaminated cracking catalysts such as disclosed in U.S. Pat. No. 4,406,773 of W. P. Hettinger, Jr. and R. M. Benslay, and U.S. Pat. No. 4,359,379 of Nippon Oil Company.

II. Description of the Prior Art

U.S. Pat. No. 4,591,425 to S. M. Kovach and C. M. Miller discloses the desirability of making use of cracking catalyst from a fluid catalytic cracking unit to convert increasingly more metal contaminated hydrocarbon feeds. Broadly, for purposes of this specification and claims, the term "hydrocarbyl" feed shall mean a petroleum feedstock characterized as follows: % by weight of hydrogen in the range of 6–18%; of carbon in the range of 67–94%; of metal contaminates comprising nickel, cobalt, magnesium, vanadium, and sulfur in the range of 0–15%; any other typical characteristic that is used to characterize crude like viscosity, etc.; and a Conradson carbon number in the range 0–30%. "FCC" shall mean throughout this specification fluid catalytic cracking as further defined in the Petroleum Handbook. Catalytic cracking is defined and described in *Shreve's Chemical Process Industries,* 5th ed., by George T. Austin, Chapter 37, pp 735–740. Catalytic cracking is also defined and described in *Petroleum Refining Technology and Economics,* 2nd ed., by James H. Gary and Glenn E. Handwerk, Chapter 7, pp 99–108.

U.S. Pat. No. 4,359,379 to Ushio et al. (Dec. 16, 1980), assigned to Nippon Oil Company, Ltd., discloses a process for fluid catalytic cracking of distillation residual oils. A part of the catalyst particles are withdrawn in a stream of a carrier fluid consisting of air, nitrogen, or steam and mixtures thereof, at a rate of 0.01 to 100 meters/second in a particle concentration of 0.01 to 500 grams/liter to a high gradient magnetic separator. A ferromagnetic matrix is placed in a uniform high magnetic field to generate a high magnetic gradient around the matrix, thereby separating the withdrawn particles into a group of particles rendered magnetic by the deposition of nickel, vanadium, iron, and copper. These metals were contained in the starting oil. The non-magnetic particles are returned to the fluid catalytic cracking unit for re-use.

SUMMARY OF THE INVENTION

I. General Statement of the Invention

This invention arises from the discovery that instead of simply recycling magnetically separated cracking catalysts back to an FCC unit, there is a benefit in terms of activity and selectivity in sending a portion of such magnetically separated cracking catalyst to a separate FCC unit, that is operated at different conditions from those of the FCC unit from which the separated catalyst was removed. In other words, this invention involves a process for the cascading of spent equilibrium catalyst from at least one first fluid catalytic cracking unit to a second fluid catalytic cracking unit. The primary difference between the first and the second unit resides in the characteristics of the hydrocarbyl feed stocks used in each. The characteristics of the hydrocarbyl feed in the one or more first units are: boiling range of preferably 430° F. and higher with no more than 10 weight percent (wt. %) boiling above 1050°, more preferably 450° F. and higher with no more than 5 wt. % boiling above 1050, and most preferably 480° F. and higher with no more than 2 wt. % boiling above 1050. The relative characteristics of the hydrocarbyl feed in the second unit are: the second feed is higher in Ramsbottom carbon content preferably by at least 0.5, more preferably at least 1, and most preferably at least 2, with the general range increase in Ramsbottom carbon content being about 0.5 to 4; in iron/vanadium content by a ratio preferably in the range 10:1 to 1:10, more preferably in the range 2:1 to 1:10, and most preferably in the range 1:1 to 1:10; iron/nickel content by a ratio preferably in the range 10:1 to 1:10, more preferably by a ratio in the range 2:1 to 1:10, and most preferably by a ratio in the range 1:1 to 1:10; and/or content of material boiling above 1050° F. increased by an amount in percent by weight preferably in the range 10–70%, more preferably in the range 20–70%, and most preferably in the range 30–70%. Using magnetically separated equilibrium catalyst from the first unit caused improved yields and selectivity that the unseparated catalyst from the first unit or its recycle did not appear to provide. The benefits of this invention are found to result from differences in metal content, Conradson carbon, and to a lesser degree the minimum boiling point of hydrocarbyl feed.

Generally, the relative characteristics of the first hydrocarbyl feed relative to that of the second are set out in the following table:

| | One or More First Crackers | One or More Second Crackers |
|---|---|---|
| minimum metal content of feed | 0–5 ppm Ni<br>0–5 ppm V<br>0–25 ppm Fe<br>0–1 ppm Cu | ≧5 ppm Ni<br>≧5 ppm V<br>≧5 ppm Fe<br>Cu may not be higher |
| minimum metal contamination of the catalyst before magnetic separation | ≧1000 ppm Ni + V | |
| % rejection in magnetic separation | 1–99% (more preferably at least 20%) | Receives some or all the lesser magnetic from the mag. separator |
| Conradson Carbon number | 0.1–2 wt % | 2–20 wt % |
| others of relevance | | |
| Simulated distillation of feed | ≦10% boiling greater than 1050° F. | ≦70% boiling greater than 1050° F. |

In other words, the minimum metal content of feed in the first cracker is less than 5 ppm for Ni, V, Fe, or Cu; more preferably less than 1 ppm for Ni, V, Fe, or Cu; most preferably less than 0.5 ppm for Ni, V, Fe, or Cu; but generally more than at least 0.4; whereas the minimum metal content of feed in the second cracker is preferably at least 3 ppm for Ni, V, Fe; more preferably at least 5 ppm for Ni, V, Fe; and most preferably at least 7 ppm for Ni, V, Fe; wherein in all cases the amount of Cu may not be increased in the second reactor over that of the first.

The minimum metal contamination of the catalyst before magnetic separation is preferably at least 500 ppm Ni+V; more preferably at least 1000 ppm Ni+V; and most preferably at least 1500 ppm Ni+V.

The Conradson Carbon number in the first reactor is preferably in the range 0.1–2, more preferably in the range 0.1–1.5, and most preferably in the range 0.1–1; and the Conradson Carbon number in the second reactor corresponding to each of these ranges is preferably in the range 2–20; more preferably in the range 1.5–20; and most preferably 1–20.

In particularly preferred embodiments, the feed to said first unit comprises at least about 1000 ppm by weight Ni+V and has a Conradson carbon number of about 0.1 to 2, and the magnetic separation is operated with a rejection rate of from 1–99%.

In still another embodiment of this invention, there is the addition of a harmless magnetic substance which accumulates at the same rate, as for example nickel and vanadium, and facilitates magnetic separation. Examples of such substantially harmless materials are disclosed in U.S. Pat. No. 5,230,869, U.S. Pat. No. 5,1.71,424, and U.S. Pat. No. 5,198,089.

II. Utility of the Invention

We have discovered that there is an advantage to using magnetically separated cracking catalyst from one or more first FCC units in a second FCC unit. The magnetic cut can be done in three different cuts. For example, preferably at least 20% by weight of the more magnetically active material is discarded before transfer from the first cracker to the second; more preferably at least 50% by weight of the more magnetically active material is discarded; and most preferably at least 70% by weight of the more magnetically active material is discarded. An improvement in both yields and selectivity are found. The benefit occurs when a different feed stock from that in a first FCC unit is contacted in a second FCC unit with the magnetically separated FCC equilibrium catalyst from the one or more first FCC units.

Iron and magnesium magnetic hooks were found to be preferable to heavy rare earth family magnetic hooks in many instances. For example, the rate of addition of iron was preferably in the range of up to two to three times, and possibly more, the level of nickel and vanadium in the feedstock. The rate of addition of manganese is preferably at any rate between 0.1 ppm and 100 ppm, so as to deposit on total equilibrium catalyst in amount from 100 to 50,000 ppm.

Example of a suitable manganese containing compounds are monocyclopentadiene tricarbonyl. Examples of suitable iron containing magnetic hooks are: sublime able iron trichloride and iron carbonyls, organic compounds like ferrocene, or iron porphyrins, and water soluble salts such as ferrous acetate, ferric formate and ferrous or ferric sulfate.

BRIEF DESCRIPTION OF THE DRAWINGS

The FIGURE is a schematic drawing of two FCC units and a magnetic separator.

DESCRIPTION OF THE PREFERRED EMBODIMENTS

Referring to the FIGURE, there are: a first FCC unit 10 which may represent more than one unit, a magnetic separator 11 which also represents one or more units, a second FCC unit 20, a series of conduits into and out of first FCC unit 10: conduit 12 for a first feedstock, conduit 13 for cold spent catalyst from other FCC units that are like the first FCC, conduit 14 for both magnetically separated cracking catalyst and fresh or make-up cracking catalyst, conduit 15 for a first portion of magnetically separated and recycled cracking catalyst, conduit 16 for product, conduit 17 for a second portion of magnetically separated cracking catalyst separated in first magnetic separator 11, conduit 18 for the contaminated catalyst from the first FCC unit, conduit 19 for a greater magnetic discard stream from the magnetic separator, and a series of conduits into and out of second FCC unit 20: conduit 22 for second feedstock, conduit 24 for make-up cracking catalyst, conduit 26 for product, conduit 27 for discarded catalyst.

Briefly, the schematic diagram discloses the following preferred operation of the invention. Into first FCC unit 10 a hydrocarbyl feedstock having the following characteristics is introduced through conduit 12 at a rate sufficient to give a flowing catalyst-to-oil weight ratio of 2.5 to 15. The riser cracker conditions of FCC unit 10 are: 0.1 to 3 seconds residence time, 350° to 550° F. input feed temperature, 890° to 1010° F. outlet temperature, 0.01 to 0.5 lbs/barrel make-up catalyst rate. The riser cracker conditions of FCC unit 20 are: the same ranges as FCC #1. Catalyst recycle rate varies from 1 to 99% by wt., and percent rejection rate varies from 1 to 99% by wt. from magnetic separator 11. Rate of transfer of catalyst from first FCC unit 10 to magnetic separator 11 through conduit 18 in pounds (kilograms) per hour is 0 to 2 tons/hr. Rate of transfer through conduit 13 is from 0 to 2 tons/hr. Hydrocarbyl product exits through conduits 16 and 26, respectively. The respective properties of each product and feed entering and leaving from first and second FCC units, 10 and 20, respectively are given in the Example.

EXAMPLE

This Example shows how to best practice the invention of this specification. The following table shows comparative results.

| | First Cracker | Second Cracker | Benefit |
|---|---|---|---|
| minimum metal content of feed | <1 ppm each of Ni, V, Fe, Cu | ≧5 ppm each of Ni, V, Fe: Cu may be ≦1 ppm still | All or a portion of the feed to the 2nd cracker generally has lower acquisition & fractioning (preparation) costs than the feed to the 1st cracker. |
| minimum metal contamination of the catalyst before magnetic separation | 1000 ppm Ni + V | | |
| % rejection in magnetic separation | 1–99% | not processed | Allows use of high activity & low metals recycled catalyst in the 2nd FCC. |
| Conradson Carbon number | 0.1–2 | 2–20 | |
| others of relevance | | | Very low activity & high metals catalyst is kept out of the |

-continued

| First Cracker | Second Cracker | Benefit |
|---|---|---|
| | | 2nd FCC. Those items are detrimental to the yields & activity in 2nd FCC. Use of invention allow low or zero addition of expensive fresh make-up catalyst to 2nd FCC, yet obtain equivalent yields & activity as would be obtained with normal fresh make-up rates without the invention. |

Modifications

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the inventions disclosed herein. An example of a modification of this invention is the use of a second magnetic separator which separates equilibrium catalyst from the second cracker into fractions for recycle back into the second cracker or other processing unit. The cuts for rejecting catalyst in the magnetic separator from the second cracker are preferably at least 50%, more preferably at least 75% and most preferably at least 90%

Although iron and manganese seem to enhance separations better in some instances over heavy rare earth family metals, there is a synergistic benefit that arises out of improved yields in the second cracker due to the presence of materials such as gadolinium, terbium, dysprosium,erbium, and thulium. The amount of heavy rare earth family metals that are present on the catalyst in the second cracker are preferably in the range 5 to 10,000 ppm, more preferably in the range 100 to 5,000 ppm, and most preferably in the range 200–4000 ppm.

Reference made to any other specification is intended to result in such patents or literature being expressly incorporated herein by reference including any patents or other literature references cited within such patents. Any reference to a numerical range is intended to expressly incorporate herein by reference each and every numerical value within such range and each and every numerical range within such range. For example, a given range of 1 to 100 is intended to include 23, a value within the given range of 1 to 100, and 10 to 70, a range within the given range.

What is claimed is:

1. A process for the cascading of spent equilibrium catalyst from at least one first fluid catalytic cracking unit in which the catalyst contacts a first hydrocarbyl feed under cracking conditions to produce a first product having a lower average molecular weight as determined according to ASTM D-2887 than said first hydrocarbyl feed, said process comprising in combination:

(a) removing at least a portion of said spent equilibrium catalyst from said at least one first fluid catalytic cracking unit;

(b) subjecting at least a portion of said removed spent equilibrium catalyst to magnetic separation in which the spent catalyst which has accumulated amounts of metal contamination is separated into a lesser-metal-containing fraction, and a greater-metals-containing fraction; and (c) thereafter contacting at least a portion of said lesser-metal-containing fraction in a second fluid catalytic cracking unit with a second hydrocarbyl feed having a higher content of metals than said first hydrocarbyl feed, as determined by atomic absorption for nickel/iron/vanadium/copper, to produce a second product having lower average molecular weight than said second hydrocarbyl feed; and catalyst comprising additional metal contamination which enhances the activity and selectivity of the cracking process occurring in said second fluid catalytic cracking unit.

2. The process of claim 1, wherein process conditions for both units are: catalyst-to-oil weight ratio is in the range of about 2.5 to 15; residence time in seconds is in the range of about 0.1 to 3; input feed temperature is in the range of about 350°–550° F.; outlet temperature from units is in the range of about 890° to 1010° F.

3. The process of claim 2, wherein the feed to said first unit comprises at least about 1000 ppm by weight Ni+V, and has a Conradson carbon number of about 0.1 to 2, and wherein the magnetic separation is operated with a rejection rate of from 1–99%.

4. The process of claim 2, wherein the feed to said second unit comprises more than about 5 ppm by weight each of Ni, V, Fe, and wherein said second hydrocarbyl feed has a Conradson carbon number of about 2 to 20.

5. The process of claim 1, wherein said magnetic separation rejects at least 20% by weight of said catalyst into said greater metals containing fraction.

6. The process of claim 1, wherein said feed to said first fluid catalytic cracking unit has a boiling range of 430° F. and higher with no more than 10% boiling above 1050° F. and Ramsbottom carbon content of said second feed is higher than that of said first feed by at least 0.5.

7. The process of claim 1, wherein the feed to said first fluid catalytic cracking unit comprises between 0.4 and 5 ppm Ni, V or Fe and the feed to said second fluid catalytic cracking unit comprises greater than or equal to 3 ppm Ni, V or Fe.

* * * * *